US005253587A

United States Patent [19]

Thouron et al.

[11] Patent Number: 5,253,587

[45] Date of Patent: Oct. 19, 1993

[54] SEPARATION AND AERODYNAMIC BRAKING DEVICE FOR THE PROPULSION STAGE OF A MISSILE

[75] Inventors: René Thouron, La Ferte St Aubin; Pascal Herrero, Clery St Andre, both of France

[73] Assignee: Thomson-Brandt Armements, La Ferte Saint Aubin, France

[21] Appl. No.: 996,779

[22] Filed: Dec. 23, 1992

[30] Foreign Application Priority Data

Dec. 23, 1991 [FR] France ..... 91 16040

[51] Int. Cl.[5] ..... F42B 4/06

[52] U.S. Cl. ..... 102/351; 102/348; 102/354; 102/489

[58] Field of Search ..... 102/348, 351, 354, 489

[56] References Cited

U.S. PATENT DOCUMENTS

| | | | |
|---|---|---|---|
| 2,976,804 | 3/1961 | Hickman | 102/49 |
| 3,055,300 | 9/1962 | Stoehr | 102/35.4 |
| 4,526,105 | 7/1985 | Herren, Jr. | 102/498 |
| 4,649,826 | 3/1987 | Stevens | 102/340 |
| 4,714,020 | 12/1987 | Hertsgaard et al. | 102/351 |
| 4,879,941 | 11/1989 | Repe et al. | 89/1.14 |
| 4,930,422 | 6/1990 | Thouron et al. | 102/378 |
| 4,986,188 | 1/1991 | Denis et al. | 102/493 |
| 5,016,836 | 5/1991 | Thouron | 244/3.2 |
| 5,044,281 | 9/1991 | Ramsay et al. | 102/340 |
| 5,103,734 | 4/1992 | Arnaud et al. | 102/489 |

FOREIGN PATENT DOCUMENTS

| | | |
|---|---|---|
| 256952 | 2/1988 | European Pat. Off. . |
| 424337 | 4/1991 | European Pat. Off. . |

*Primary Examiner*—Peter A. Nelson

*Attorney, Agent, or Firm*—Oblon, Spivak, McClelland, Maier & Neustadt

[57] ABSTRACT

This device concerns missiles and in particular those made up of a payload stage in the form of a sub-munitions cargo-container and a propulsion stage. It is intended for the separation and aerodynamic braking of the propulsion stage at the end of its operation so that the sub-munitions can be released without the risk of hitting it. It includes attachment by fitting and locking by shear screws of the two parts of the missile, an inflatable bag arranged in an annular housing, a mobile piston used to separate the two parts of the missile, an initiatable gas generator driving the mobile piston then inflating the bag, means of initiating the gas generator consisting of a primer and firing pin and sensitive to a drop in pressure of the gases in the propulsion stage.

6 Claims, 3 Drawing Sheets

SEPARATION AND AERODYNAMIC BRAKING DEVICE FOR THE PROPULSION STAGE OF A MISSILE

BACKGROUND OF THE INVENTION

The present invention concerns missiles, in particular, those comprising a sub-munitions cargo-container and a cruise motor or propeller.

SUMMARY OF THE INVENTION

The object of the invention is the separation of the cruise propeller from the sub-munitions cargo-container and the aerodynamic braking of this propeller so that the sub-munitions can be released without the risk of hitting it.

The object of the invention is a device for separation and aerodynamic braking of the propulsion stage of a missile which includes:

- means of attachment locking the propulsion stage to the rest of the missile known as the payload stage, these means being shearable to enable separation;
- an annular housing for an inflatable bag located at one extremity of the propulsion stage at its interface with the payload stage and closed by hinged flaps which open out after separation of the means of attachment of the propulsion and payload stages;
- an inflatable bag, attached to the propulsion stage and placed deflated in said annular housing, which when inflated comes out of the housing to augment the effective cross-sectional area of the propulsion stage;
- a tubular piston for separation of the propulsion and payload stages which is mobile within a hollow cylindrical support fixed to the propulsion stage, placed at the center of the said annular housing and oriented in a direction parallel to the direction of separation of the means of attachment of the propulsion and payload stages, and which has a passive position in which it is retracted into the cylindrical support and a working position in which it emerges from the cylindrical support and comes into contact with the payload stage which it then pushes away until the means of locking and separation of the means of attachment are sheared;
- at least one opening in the wall of the cylindrical support which is uncovered by the tubular piston when it moves into a working position and which connects the internal volumes of the cylindrical support and the inflatable bag;
- an initiatable gas generator which is arranged inside the tubular piston and which, when it is primed, pushes the piston into a working position which leads to the separation of the propulsion stage and inflates the bag, and;
- means of initiating the gas generator capable of detecting the end of operation of the propulsion stage.

Advantageously, the means of initiating the gas generator include a primer pellet pressed against the gas generator in the cylinder when the tubular piston is in its passive position, a mobile firing pin in the form of a point carried by a sliding hollow base in the cylindrical support, facing the primer pellet, on the opposite side from the gas generator, pushed by a spring towards the primer pellet but kept at a distance from it by a retaining device releasable at the end of operation of the propulsion stage.

Advantageously, the retaining device of the mobile firing pin includes at least one ball located in a housing mounted in the wall of the cylindrical support and in the firing pin base and a mobile plunger which penetrates into the firing pin base to keep the ball enclosed in its housing and which is partially withdrawn at the end of operation of the propulsion to enable the ball to escape from its housing and thus release the firing pin.

Advantageously, the plunger of the firing pin retaining device is activated by a piston head which is fixed at its end on the opposite side of the base from the firing pin, against which presses the spring pushing the firing pin base towards the primer pellet and which can slide along a cylindrical support chamber communicating with the internal volume of the propeller subjected to the pressure of the propulsion gases.

BRIEF DESCRIPTION OF THE DRAWINGS

Other characteristics and advantages of the present invention will become apparent on reading the following description of an embodiment, given as an example, with reference to the attached drawings which represent.

DESCRIPTION OF THE INVENTION

Figure 1:
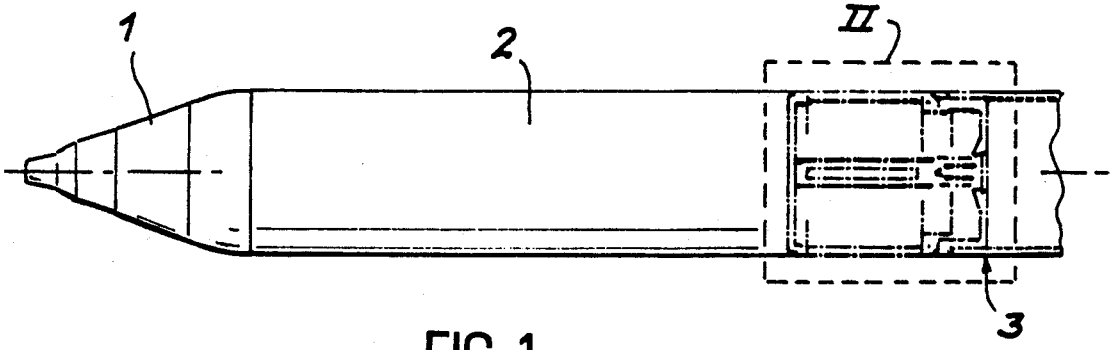
FIG. 1 represents a partial view of a missile showing, in profile, its front part, and in section, the start of its propulsion stage with, in box II, an interface area containing a device for separation and braking in its passive state.

The missile represented in FIG. 1 has a cylindrical body with a conical head 1. It includes two stages, a payload stage or front part 2 made up of a sub-munitions container and a propulsion stage or rear part 3 made up of a cruise propeller. The propeller or rear part 3 must be held attached to the sub-munitions container or front part 2, before and during the propelled flight of the missile, then separated from the front part 2 and braked at the end of propelled flight, to enable the release of the sub-munitions without risk of hitting the rear part 3.

The front part 2 and rear part 3 of the missile are assembled by fitting into each other. For this purpose, front part 2 of the missile constituting the sub-munitions container is finished by a cap 4 with its concave face facing the rear part 3, with on its circumference a rim 5 which aligns with the wall of the missile and into which fit the rim 6 of the complementary profile of the extremity of the wall of the rear part 3. Shear screws 7 are placed on the circumference of the cap 4 at the interface between the front and rear parts and penetrate into the rim 6 of the extremity of the wall of the rear part 3 to fix the two parts together.

The rear part 3 of the missile contains, in its interface area with front part 2, an annular housing 8 closed by flaps 9, 10 with pivots 11, 12 and opening to the outside and from the front towards the rear of the missile after a separation of the front part 2 and rear part 3 of the missile following rupture of the shear screws 7. The annular housing 8 is traversed axially along its whole length by a hollow cylindrical support 13 and contains an inflatable bag attached to the exterior wall of the hollow cylindrical support 13.

Figure 4:
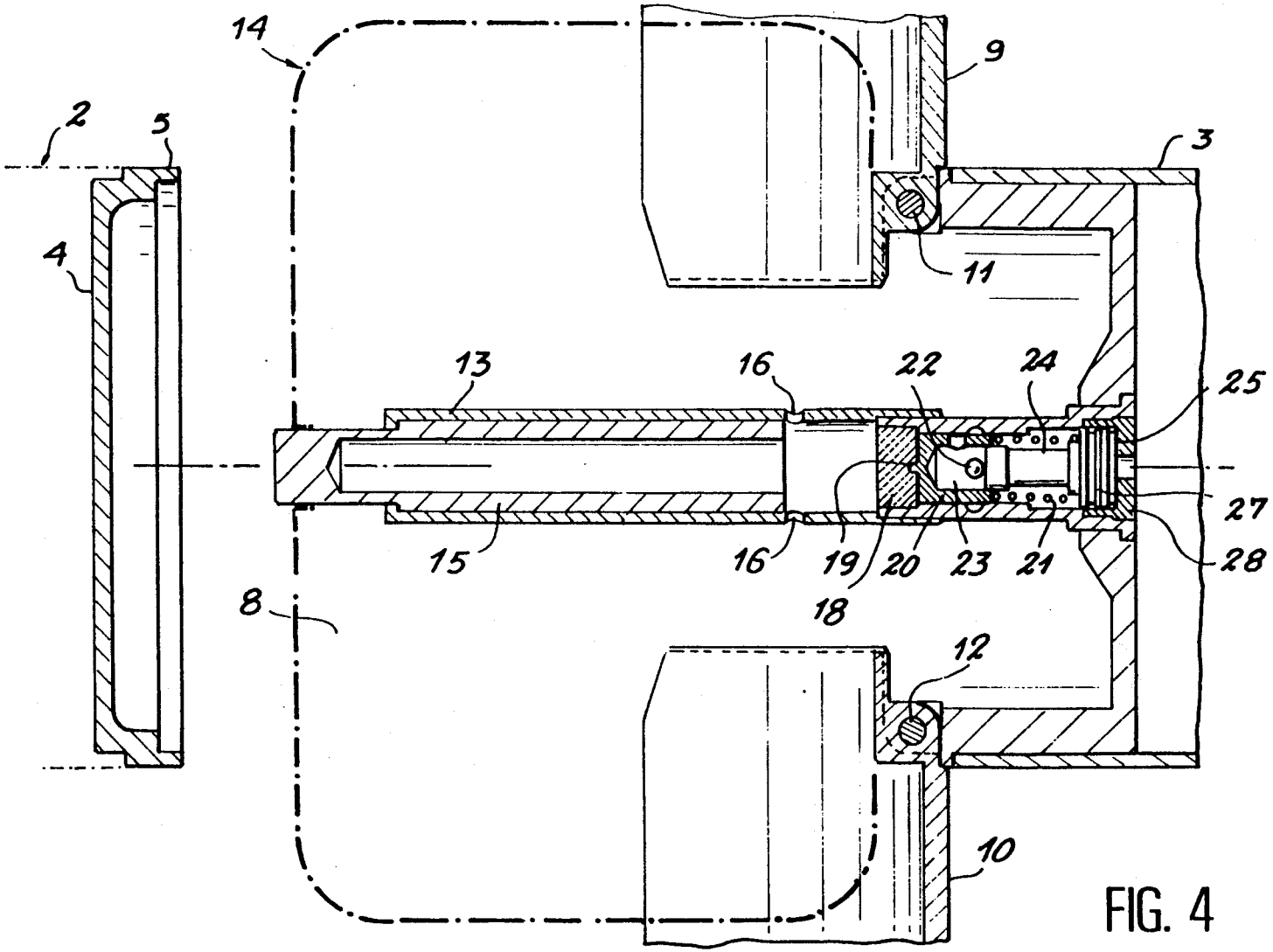
FIG. 4 represents an enlargement of the section of the interface area at the front of the propulsion stage as in FIG. 3 and illustrating the positions taken by the elements of the separation and braking device after its activation.

This hollow cylindrical support 13 which is fixed to the rear part 3 of the missile contains a tubular piston 15 which can move between a passive position (FIG. 2) in which it is entirely retracted in the cylindrical support 13 and a working position (FIG. 4) in which it emerges from the cylindrical support 13, pushing against the rear of the cap 4 of the front part 2 of the missile and forcing it back after breaking the shear screws 7, ensuring the total separation of the assembly and uncovering openings 16 in the wall of the cylindrical support 13 connecting the internal volume of the inflatable bag 14 with the internal volume of the hollow cylindrical support 13 and the tubular piston 15.

An initiatable gas generator 17 inside the tubular piston 15 is used to force the piston 15 into its working position to separate the front part 2 and the rear part 3 of the missile and, once this separation has been achieved, to inflate the bag 14. It is initiated by means of a primer pellet 18, pressed in the hollow cylindrical support 13 against the internal extremity of the tubular piston 15 when it is in a passive position.

The primer pellet 18 is detonated by means of a mobile firing pin in the form of a point 19 carried by a sliding hollow base 20 in the hollow cylindrical support 13, on the opposite side from the gas generator 17.

The sliding hollow base 20 is pushed by a spring 21 towards the primer pellet 18 but maintained at a distance by a releasable retaining device.

The releasable retaining device blocking the path of the firing pin comprises one or more balls 22, located in housings in the wall of the hollow cylindrical support and in the wall of the hollow base 20 of the firing pin, and a mobile plunger 24 which penetrates into the base 20 of the firing pin to keep the ball(s) in their housing or partially withdraws to enable the ball(s) to escape from their housing by falling into a central chamber 23 and thus releasing the firing pin.

The mobile plunger 24 for the release of the retaining mechanism of the firing pin is activated by a piston head 25 which is fixed to its extremity on the opposite side from the firing pin. This piston head 25 against which rests the spring 21 pushing the base 20 of the firing pin towards the primer pellet 18 slides along a chamber 26 of the hollow cylindrical support 13 communicating with the internal volume of the propulsion stage 3 subjected to the pressure of propulsion gases.

A shearable washer or key 27 fixed half way along the side of the piston head 25 engages a circular internal groove of the hollow cylindrical support 13 located half way along chamber 26, at the intersection of the latter with a plug 28, to maintain the firing pin in a ready position, at a distance from primer pellet 18, during storage of the missile prior to its use. The resistance to shearing of this washer 27 is significantly greater than the force produced by the spring 21 on the base 20 of the firing pin acting towards the primer pellet 18 but less than the thrust force exerted on the piston head 25 by the gases generated in the propulsion stage 3 after its ignition.

Figure 2:
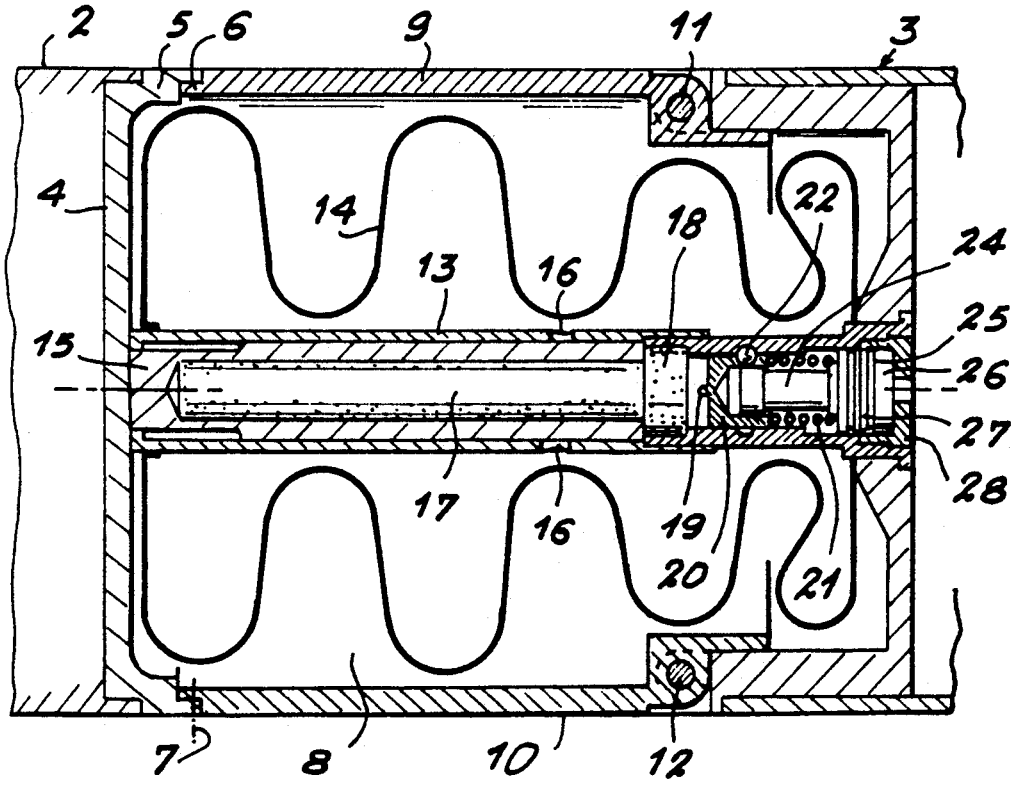
FIG. 2 represents an enlargement of the section of the interface area in box II in FIG. 1.

During storage of the missile prior to the ignition of its propeller, the device for separation and braking of the propulsion stage is in the state represented in FIGS. 1 and 2. The firing pin is in a ready position at a distance from the primer pellet 18, blocked by the shearable washer 27. The gas generator 17 is in a non-initiated state, inside the tubular piston 15 which is in a retracted position in the cylindrical support 13. The bag 14 is deflated and placed inside the annular housing 8 of which the flaps 9 and 10 are closed with their extremities fitted into and fixed by shear screws 7 to the front part 2, the missile sub-munitions container.

As soon as the missile propeller is ignited, the firing pin is armed by the rupture of the shearable washer 27 under the force of the pressure of propulsion gases, the piston head 25 fixed to the plunger 24 being pushed fully into chamber 26.

Figure 3:
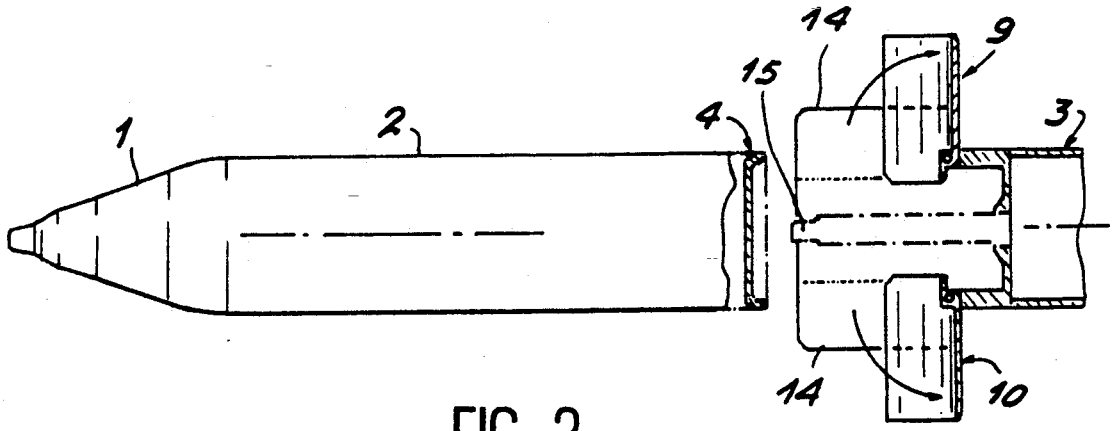
FIG. 3 represents a partial view of the missile in FIG. 1 showing, in profile, its front part, and, in section, the start of its propulsion stage at the moment of separation from the front part after activation of the separation and braking device.
Figure 5:
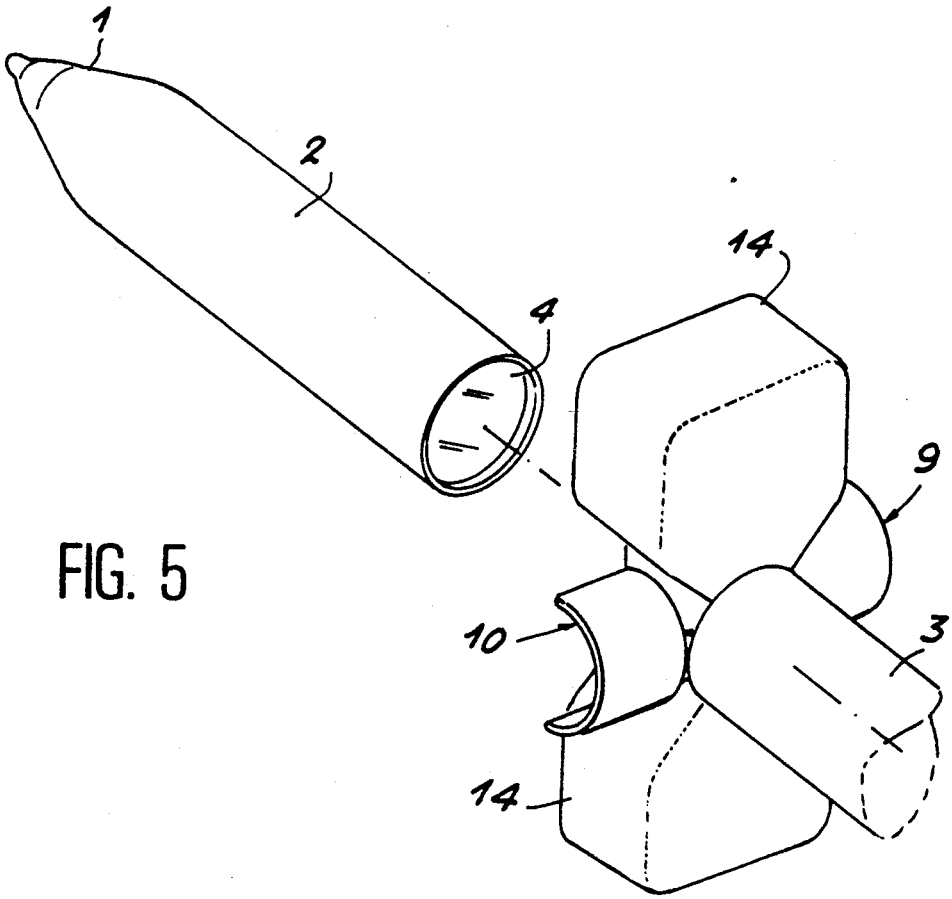
FIG. 5 represents in perspective a partial view of the missile seen in figures 1 and 3, in which the front part has just separated from its propulsion stage and the elements of the device of separation and braking have been deployed.

When the propeller extinguishes, the piston head 25 fixed to the plunger 24 is no longer subjected to the pressure of the propulsion gases. Under the thrust of the spring 21 of the firing pin base 20 it moves back along the chamber 26 to meet the plug 28, drawing with it the mobile plunger 24 which partially withdraws from base 20. This withdrawal enables the escape of the ball(s) 22 securing the firing pin which then strikes the primer pellet 18 under the thrust of the spring 21. This in turn initiates the gas generator which generates gases tending to push the tubular piston 15 out of the cylindrical support 13 against the cap 4 of the front part 2, the missile sub-munitions container. The thrust of the tubular piston 15 ruptures the shear screws 7, separates the front part 2 and rear part 3 of the missile and liberates the flaps 9, 10 of the annular housing 8. Having arrived at the end of its travel, the tubular piston 15 uncovers, in the wall of the cylindrical support 13, the openings 16 by which the gases of generator 17 escape towards the internal volume of the bag 14 which inflates. The separation and braking parts of the propulsion stage are then found in the positions represented in FIGS. 3, 4 and 5.

The opening of the flaps 9, 10 and the inflating of the bag 14 after separation between the propulsion stage and the sub-munitions container stage increases enormously the drag of the propulsion stage which is therefore braked by the air much more than the submunitions container stage.

What is claimed is:

1. Device for the separation and the aerodynamic braking of a propeller stage including:

means of attachment locking the propulsion stage to the rest of the missile known as the payload stage, these means being shearable to enable separation;

an annular housing for an inflatable bag located at one extremity of the propulsion stage at its interface with the payload stage and closed by hinged flaps which open out after separation of the means of attachment of the propulsion and payload stages;

an inflatable bag, attached to the propulsion stage and placed deflated in said annular housing, which when inflated comes out of the housing to augment the effective cross-sectional area of the propulsion stage;

a tubular piston for separation of the propulsion and payload stages which is mobile within a hollow cylindrical support fixed to the propulsion stage, placed at the center of the said housing and oriented in a direction parallel to the direction of separation of the means of attachment of the propulsion and payload stages, and which has a passive position in which it is retracted into the cylindrical support and a working position in which it emerges from the cylindrical support and comes into contact with the payload stage which it then pushes away until the means of locking and the separation of the means of attachment are sheared;

at least one opening in the wall of the cylindrical support which is uncovered by the tubular piston when it moves into a working position and which connects the internal volumes of the cylindrical support and the inflatable bag;

an initiatable gas generator which is arranged inside the tubular piston and which, when it is primed, pushes the piston into a working position which leads to the separation of the propulsion stage and inflates the bag, and;

means of initiating the gas generator capable of detecting the end of operation of the propulsion stage.

2. Device according to claim 1, wherein the said means of initiating include:

a primer pellet pressed against the gas generator in the cylinder;

a mobile firing pin placed in the cylindrical support facing the primer pellet on the opposite side from the gas generator;

means of propelling the firing pin towards the primer pellet;

means of retaining the firing pin away from the primer pellet;

means of releasing the retaining means of the firing pin capable of detecting the end of operation of the propulsion stage.

3. Device according to claim 2, wherein the firing pin is in the form of a point carried by a base sliding in the cylindrical support, facing the primer pellet.

4. Device according to claim 3, wherein the means of propelling the firing pin towards the ignition device are in the form of a spring under compression.

5. Device according to claim 4, wherein the retaining means of the firing pin include at least one ball located in a housing mounted in the wall of the cylindrical support and in the firing pin base and a mobile plunger which penetrates into the firing pin base to keep the ball enclosed in its housing and which is partially withdrawn at the end of operation of the propulsion to enable the ball to escape from its housing and thus release the firing pin.

6. Device according to claim 5, wherein the means of releasing the retaining means of the firing pin include a piston head which is fixed at the end of the plunger on the opposite side of the base from the firing pin, against which rests the spring propelling the firing pin base against the primer pellet and which can slide along a chamber of the hollow cylindrical support communicating with the internal volume of the propeller subjected to the pressure of the propulsion gases, and a shearable washer fixed half way along the side of the piston head which immobilizes the firing pin in a ready position during storage of the missile prior to its use, the resistance to shearing of the said washer being significantly greater than the force exerted by the spring pushing the firing pin base towards the primer pellet and less than the force exerted on the piston head by the gases generated in the propulsion stage after its ignition.

* * * * *